United States Patent [19]

Kindlmann et al.

[11] Patent Number: 4,495,981

[45] Date of Patent: Jan. 29, 1985

[54] PROCESS AND APPARATUS FOR SYNCHRONIZED ELECTROMAGNETIC CASTING OF MULTIPLE STRANDS

[75] Inventors: Peter J. Kindlmann, Guilford; John C. Yarwood, Madison; Gary L. Ungarean, Woodbridge; Derek E. Tyler, Cheshire, all of Conn.

[73] Assignee: Olin Corporation, New Haven, Conn.

[21] Appl. No.: 317,373

[22] Filed: Nov. 2, 1981

[51] Int. Cl.[3] ..... B22D 27/02

[52] U.S. Cl. ..... 164/452; 164/467; 164/503; 164/154

[58] Field of Search ..... 164/466, 467, 471, 493, 164/498, 147.1, 503, 507, 513, 452, 154; 363/71, 26, 41; 323/267

[56] References Cited

U.S. PATENT DOCUMENTS

| | | | |
|---|---|---|---|
| 3,467,166 | 9/1969 | Getselev et al. | 164/467 |
| 3,702,155 | 11/1972 | Getselev | 164/503 |
| 4,014,379 | 3/1977 | Getselev | 164/467 X |
| 4,034,232 | 7/1977 | LaVenture | 323/267 |
| 4,161,206 | 7/1979 | Yarwood et al. | 164/467 |
| 4,367,522 | 1/1983 | Forstbauer et al. | 363/71 X |

FOREIGN PATENT DOCUMENTS

| | | | |
|---|---|---|---|
| 828340 | 5/1981 | U.S.S.R. | 363/71 |

*Primary Examiner*—Kuang Y. Lin

*Attorney, Agent, or Firm*—Howard M. Cohn; Barry L. Kelmachter; Paul Weinstein

[57] ABSTRACT

A multi-strand apparatus and process is provided for casting molten materials into ingots of desired shape. The apparatus comprises a plurality of devices for receiving and electromagnetically forming the molten material into desired shape. Each of the receiving and forming devices includes an inductor for applying a magnetic force field to the molten material. The inductor in operation is spaced from the molten material by a gap extending from the surface of the molten material to the opposing surface of the inductor. An alternating current applying device sends current to its associated inductor to generate the magnetic force field. Circuitry associated with each of the inductors senses variations in their respective gaps. The improvement comprises a pulse width modulating circuit associated with said gap variation sensing circuitry being connected to the alternating current applying device for controlling the application of alternating current to the inductor. A device is connected to the pulse width modulating circuit for synchronizing turn-on of all of the current applying devices whereby beat frequencies due to interaction between the plurality of inductors are substantially eliminated.

8 Claims, 3 Drawing Figures

PROCESS AND APPARATUS FOR SYNCHRONIZED ELECTROMAGNETIC CASTING OF MULTIPLE STRANDS

While the invention is subject to a wide range of applications, it is especially suited for use in the electromagnetic forming of a plurality of castings and will be particularly described in that connection. The process and apparatus provide for the individual head control of the molten castings with substantial elimination of beat frequency interface.

The electromagnetic casting apparatus comprises a three-part mold consisting of an inductor, a non-magnetic screen and a manifold for applying cooling water to the ingot. Such an apparatus is exemplified in U.S. Pat. No. 3,467,166 to Getselev et al. Containment of molten material, such as metal, in electromagnetic casting is achieved without direct contact between the molten metal and any component of the mold. The molten metal head is contained by a magnetic force. The magnetic force results from the passage of an alternating current through an inductor surrounding the molten metal head. Accordingly, control of the containment process involves control of the molten metal head and/or control of the alternating current amplitude. Without such control, ingots or castings of variable cross sections and surface quality result as successive equilibria between the magnetic force and the molten metal head are established. Note that the solidification of the molten metal is achieved by direct application of water from the cooling manifold to the ingot shell.

Control of the metal head may be achieved by a variety of techniques known in the art. U.S. patent application Ser. No. 110,893, now abandoned filed by Ungarean et al. entitled "Electromagnetic Casting Process and Apparatus" discloses, for example, that "the magnetic field defines a containment zone for the molten metal. The hydrostatic pressure exerted by the molten metal in the containment zone is sensed and in response thereto the flow of molten metal into the containment zone is controlled. This minimizes changes in the hydrostatic pressure."

Techniques for control of inductor current to effect molten head are also known in the art. U.S. Pat. No. 4,014,379 to Getselev discloses, for example, an electromagnetic casting system wherein "the molten metal is actuated by an electromagnetic field of an inductor, in which case the current flowing through the inductor is controlled depending on the deviations of the dimensions of the liquid zone of the ingot from a prescribed value, and thereafter, the molten metal is cooled down." Also, in U.S. Pat. No. 4,161,206 to Yarwood et al., an electromagnetic casting apparatus and process is provided wherein, for example, a "control system is utilized to minimize variations in the gap between the molten metal and an inductor which applies the magnetic field. The gap or an electrical parameter related thereto is sensed and used to control the current to the inductor."

Control of the electromagnetic process by regulation of liquid metal head at constant inductor current or voltage requires very tight control of the head, i.e. ±0.1 mm. Such control is feasible in low speed casting of large aluminum ingots, but is very difficult to achieve at moderate or high casting speeds with relatively small cross sections. Accordingly, in electromagnetic casting of copper alloys, control of inductor current is the preferred technique of regulating the height of the molten head. In this latter case, the head level must be controlled, but larger variation, i.e. ±10 mm, can be tolerated.

The above description refers to casting of one ingot (or strand) at a time. Where multi-strand casting is undertaken, control of every strand must be maintained. The prior art discloses multi-strand inductor arrangement and configurations as shown in U.S. Pat. No. 3,702,155 to Getselev, using one power supply with parallel or series connected inductors. If the inductors are connected in series to one power supply as suggested, the same current amplitude is established in each inductor independent of the conditions in any particular electromagnetic casting strand. The current depends on the supply voltage and the average conditions extant in the strands controlling their total reactance. On the other hand, if a simple parallel connection is used, the same voltage is applied to each inductor again independent of the extant conditions in a particular electromagnetic casting strand. In the latter case, individual inductor currents change as the reactance of its particular strand changes. Accordingly, independent control over voltage as required by the control systems in both U.S. Pat. Nos. 4,014,379 and 4,161,206 is not possible.

Also, U.S. patent application Ser. No. 236,386, now abandoned filed by Yarwood et al. discloses an electromagnetic casting system for forming a plurality of castings having individual head control of the castings. However, the inductors are preferably connected in series to one power supply and the current distribution is modified in each inductor to minimize variations in the gap between the inductor and the surface of the molten material. Thus, the problem of controlling each inductor independent of the conditions in a different inductor have been substantially solved.

Another possibility is to control all of the molten heads in concert in a plurality of strands. This will allow the use of either voltage or inductance control since the fixed uniform head in all of the strands allows for the use of simple fixed voltage supply. However, as disclosed in U.S. Pat. Nos. 4,014,379 and 4,161,206, such control of head is not readily attainable especially for the heavier high melting metals cast in smaller sections at moderate to high speed.

One obvious technique for controlling every strand of a multi-strand casting is to use either head or current control with each inductor using separate power supplies or inverters so that the control devices as suggested in Yarwood et al. or Getselev above could be used separately on each strand. However, this arrangement may have an undesirable characteristic. The beat frequencies as generated between interacting inductors may detract from the containment control within each inductor due to the pumping or agitation effects of low frequency alternating current which interacts with the different molten heads.

It is a problem underlying the present invention to prevent the interaction between inductors of a multi-strand electromagnetic casting system from detracting from the containment control within each of the strands.

It is an advantage of the present invention to provide a multi-strand apparatus for casting molten materials into a plurality of ingots of desired shape which obviates one or more of the limitation disadvantages of the described prior arrangements.

It is a further advantage of the present invention to provide a multi-strand apparatus for casting molten materials into a plurality of ingots wherein the generation of beat frequencies by interacting inductors is minimized.

It is a still further advantage of the present invention to provide a multi-strand apparatus and process for casting molten materials into a plurality of ingots of desired shape wherein synchronous current is applied to each of the electromagnetic casting strands.

Accordingly, there has been provided a multi-strand apparatus and process for casting molten materials into ingots of desired shape. A plurality of devices for receiving and electromagnetically forming the molten material into said desired shape is provided. Each of the receiving and forming devices includes an inductor for applying a magnetic force field to the molten material. The inductor in operation is spaced from the molten material by a gap extending from the surface of the molten material to the opposing surface of the inductor. An alternating current applying device sends current to its associated inductor to generate the magnetic force field. Circuitry associated with each of the inductors senses variations in the respective gaps. The improvement comprises a pulse width modulating circuit associated with said gap variation sensing circuitry being connected to the alternating current applying device for controlling the application of alternating current to the inductor. A device is connected to the pulse width modulating circuit for synchronizing turn-on of all of the current applying devices whereby beat frequencies due to interaction between the plurality of inductors are substantially eliminated.

The invention and further developments of the invention are now elucidated by means of preferred embodiments shown in the drawings.

Figure 1:
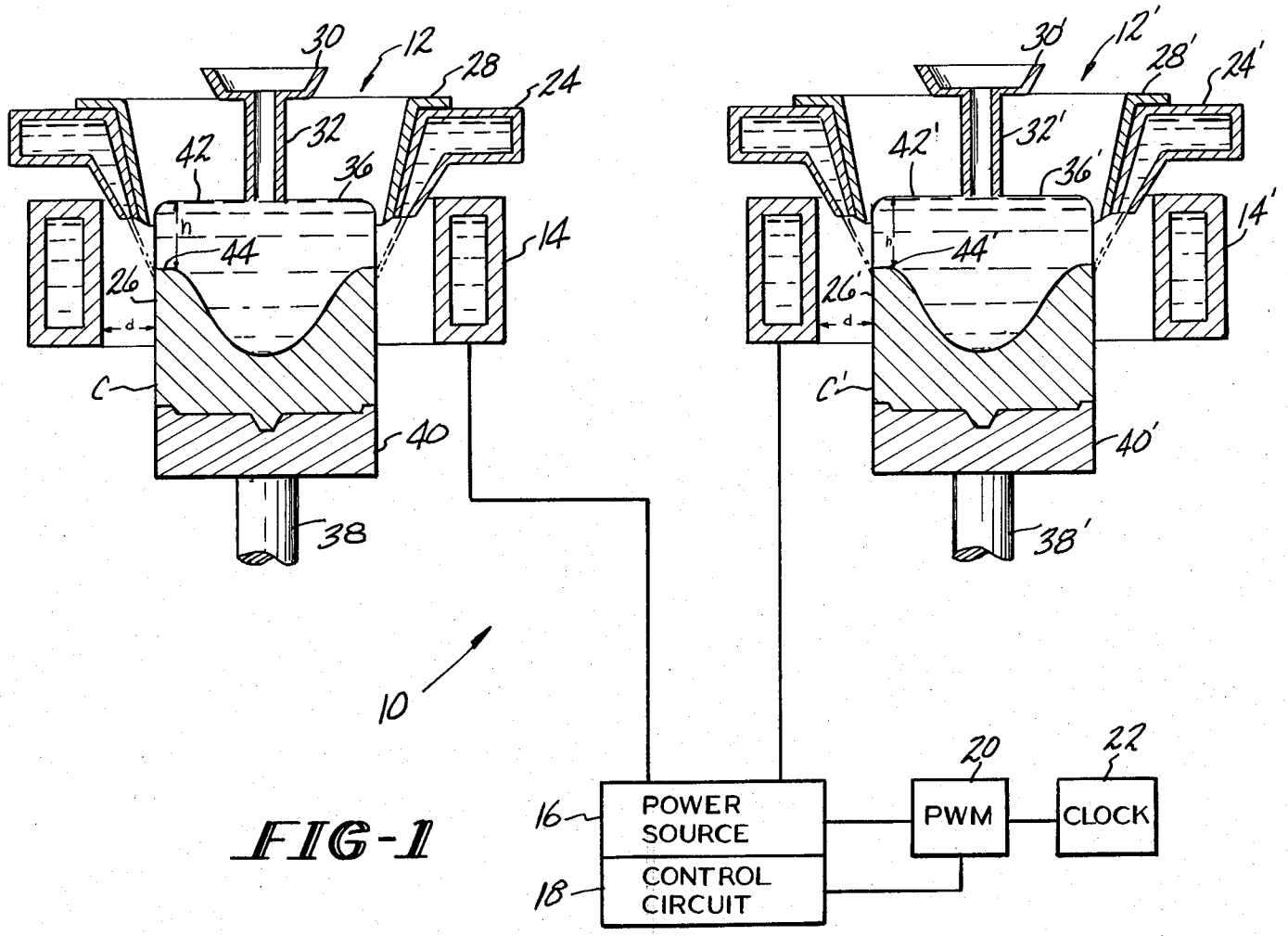
FIG. 1 is a schematic representation of an electromagnetic casting apparatus in accordance with the present invention.

A multi-strand apparatus 10 is provided for casting molten materials into ingots of desired shape. The apparatus 10 comprises a plurality of devices 12, 12' for receiving and electromagnetically forming the molten material into desired shapes. Each of the receiving and forming devices includes an inductor 14, 14' for applying a magnetic force field to the molten material. The inductor in operation is spaced from the molten material by a gap extending from the surface of the molten material to the opposing surface of the inductor. An alternating current applying device 16' 16'' sends current to its associated inductor to generate the magnetic force field. Circuitry 18', 18'' associated with each of the inductors senses variations in their respective gaps. The improvement comprises a pulse width modulating circuit 20', 20'' connected to the alternating current applying device 16' and 16'' for controlling the application of alternating current to the inductors 14, 14'. A clock device 22 is connected to each pulse width modulating circuit for synchronizing turn-on of all of the current applying devices whereby beat frequencies due to interaction between the plurality of inductors are eliminated.

Referring now to FIG. 1, there is shown by way of example an electromagnetic casting apparatus of this invention having two casting strands. Since the elements of each casting device may be substantially identical, prime numbers are used to indicate like elements. Further, only one of the molds is described in general since they both operate in the same manner.

The electromagnetic casting mold 12 is comprised of inductor 14 which is water cooled; a cooling manifold 24 applies cooling water to the peripheral surface 26 of the molten material such as metal being cast C; and a non-magnetic screen 28. Molten metal is continuously introduced into the mold 12 during a casting run using a trough 30 and downspout 32 and molten metal gap control in accordance with this invention. The inductor 14 is excited by an alternating current from a power source 16.

The alternating current in the inductor 14 produces a magnetic field which interacts with the molten metal head 36 to produce eddy currents therein. These eddy currents in turn interact with the magnetic field and produce forces which apply a magnetic pressure to the molten metal head to contain it in the zones defined by the magnetic field so that it solidifies into an ingot C having a desired cross section.

An air gap "d" exists during casting, between the molten metal head 36 and the inductor 14. The molten metal head is formed or molded into the same general shape as the corresponding inductor thereby providing the desired ingot cross section. The inductor may have any desired geometrical shape including circular or rectangular as required to obtain the desired cross section of ingot C.

The purpose of the non-magnetic screen 28 is to fine tune and balance the magnetic pressure with the hydrostatic pressure of the molten metal head. The non-magnetic screen may comprise a separate element as shown or may, if desired, be incorporated as a unitary part of the manifold for applying the coolant.

Initially, a conventional ram 38 and bottom block 40 are held in the magnetic containment zone of the mold to allow the molten metal to be poured into the mold at the start of the casting run. The ram and bottom block are then uniformly withdrawn at a desired casting rate.

Solidification of the molten metal, which is magnetically contained in the mold, is achieved by direct application of water from the cooling manifold 24 to the ingot surface 26. In the embodiment, which is shown in FIG. 1, the water is applied to the ingot surface 26 within the confines of the inductor 14. The water may be applied to the ingot surface above, within or below the related inductor as desired.

If desired, any of the prior art mold constructions or other known arrangements of the electromagnetic casting apparatus as described in the background of the invention could be employed for either one or all of the plurality of casting apparatuses used in accordance with the invention.

The present invention is concerned with the control of a multi-strand electromagnetic casting process and apparatus in order to provide cast ingots C which have a substantially uniform cross section over the length of the ingot and which are formed of materials such as metals, alloys, metalloids, semi-conductors, etc. This is accomplished in accordance with the present invention by sensing the electrical properties of the individual inductors which are a function of the gap "d" between the inductor and the load. The load consists of the molten material head corresponding to the pool of molten metal arranged above the solidifying ingot C which exerts the aforenoted hydrostatic pressure in the magnetic containment zone. In a vertical casting apparatus as shown in FIG. 1, the molten metal head 36 extends from the top surface of the molten metal pool 42 to the solid-liquid interface or solidification front 44, as indicated by "h", and further includes a limited contribution associated with the molten material in and above the downspout 32. The electrical property of the casting apparatus, which is a function of the gap between the molten metal head 36 and the interior surface of the inductor 14, is sensed by control circuit 18 and a gap signal representative thereof is generated. Responsive to the gap signal, the current delivery to the inductor is controlled so as to maintain the gap substantially constant. In addition, a pulse width modulating circuit 20 is connected to the power source 34 as well as the control circuit 18 for controlling the delivery of current to the inductors from the power source in response to the gap signal. Also, a master clock circuit 22 is connected to the pulse width modulating circuit 20 for synchronizing the turn-on of the current to each of the inductors so that beat frequencies due to interaction between the inductors are eliminated.

Figure 2:
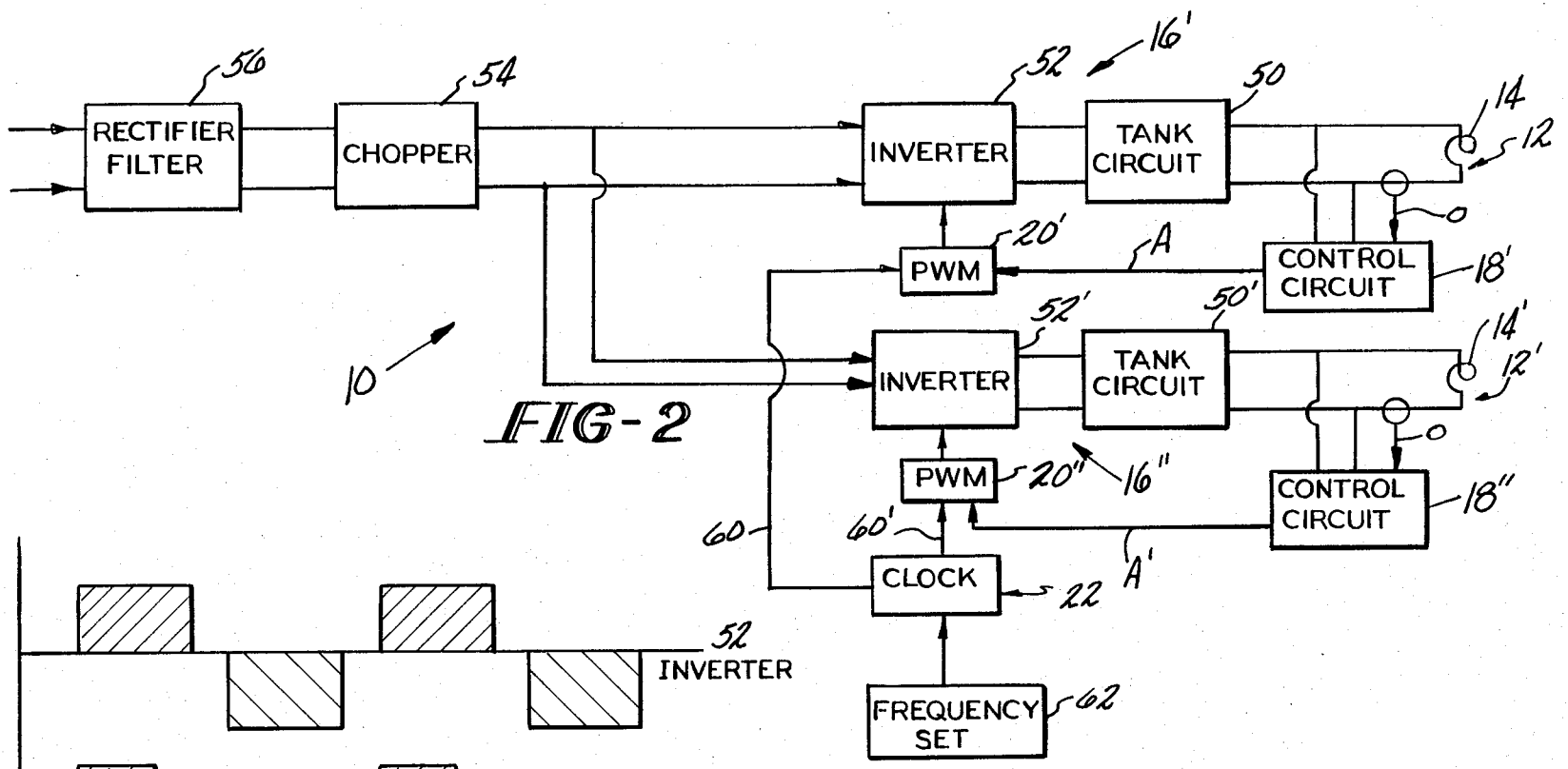
FIG. 2 is a box diagram of an electrical control system in accordance with the present invention.

Referring to FIG. 2, there is shown the general circuitry for the present invention. The subsections of the elements in FIG. 1 which are associated with each circuit are indicated by single and double prime numbers. The inductors 14 and 14' which may be considered independent of one another, i.e. neither parallel nor series connected with respect to the power source 16' and 16''. Each inductor is connected to an electrical power supply which provides the necessary current at a desired frequency and voltage. A typical power supply circuit 16', 16'' may be generally considered to have two subsections. An external circuit consisting essentially of a solid state generator providing an electrical potential across a second circuit comprising the load or tank circuit which includes the inductor. This latter tank circuit 50, 50' except for the inductor is sometimes referred to as a heat station and includes elements such as capacitors and transformers.

In accordance with this invention, the generator circuit is preferably a solid state inverter 52, 52'. The solid state inverter is preferred because it is possible to provide a selectable frequency output over a range of frequencies. This in turn makes it possible to control the penetration depth of the current in the load as described in the prior art set forth above. Both the solid state inverter 52 and the tank circuit 50 or heat station may be of a conventional design. The power supply is provided with front end DC voltage control including a chopper 54 and a rectifier filter section 56 in order to regulate the power supply output when the inverter is operated at a fixed frequency and to minimize line ripple feedthrough. The front end DC voltage control may be connected into any desired number of inverters for powering a plurality of inductors.

The control circuit 18', 18'' for sensing variations in the gap may be of any desired design including the type described in the background of this disclosure. However, preferably it is a control circuit in general accordance with the teachings of U.S. Pat. No. 4,161,206 to Yarwood et al. In that system, a reactive parameter "0" of the associated inductor is sensed which is a function of the gap "d" between the molten material head and the inductor. The sensed parameter "0" is compared with a preset value thereof and an error signal A is generated which is a function of the difference between the magnitude of the sensed parameter and a preset value thereof. As the sensed parameter "0" changes, so does the error signal A in correspondence thereto. If the sensed parameter corresponds to inductance, as in the preferred approach of the Yarwood et al. patent, then the control system is adapted to control the current delivered to the inductor in a way so as to maintain a substantially constant inductance and thereby a substantially uniform ingot cross-section.

The changes in the value of the error signal are a function of changes in the hydrostatic pressure of the molten metal head. As the molten metal head increases in height, either to an increase in the height of the upper surface or a lowering of the solidification front, or both, there is an increase in hydrostatic pressure. This hydrostatic pressure increase would normally increase the cross section of the resultant ingot C. However, the control system is effective to counteract this increase in hydrostatic pressure by adjusting the current in the inductor to compensate for the gap variation so as to drive the variation toward zero. These changes occur very rapidly, in fractions of a second, so that the inductance and cross section of the ingot appear substantially constant throughout.

A pulse width modulating circuit 20 has subsections 20', 20'' comprising individual pulse width modulating circuits. Each circuit 20', 20'' is associated with the gap variation sensing circuits 18', 18'', respectively, and is also connected to the alternating current applying devices 16', 16'' for controlling the application of alternating current to the inductors whereby variations in the gap "d" are minimized. The pulse width modulating circuit may be of a conventional design which modulates the time period in which the inverter of the current applying device delivers containment current to the inductor. The pulse width modulating circuit may provide a variable time delay. The modulating circuit could initially signal the inverter to begin delivering current to the inductor. After some time delay, a second signal would be sent to the inverter to stop sending current to the inductor. This time delay aspect of the circuit is a function of the error signal of the control circuit. It could operate by reprogramming the time delay before inverter shut-off to be longer or shorter in accordance with the magnitude error signal. For example, if the hydrostatic head increased in height requiring additional containment current to support the head, the pulse width modulating circuit in response to the error signal A would reprogram the timer for a longer delay time whereby the inverter would send additional current to the inductor so as to compensate for the increased hydrostatic pressure so as to minimize variations in the gap.

Another important aspect of the present invention is the provision of a master clock device 22 connected to the pulse width modulating circuits for synchronizing pulse width modulating circuit turn-on of all of the current applying devices whereby the inductors operate at the same frequency and with the same time relationship. In other words, there is a zero frequency difference between the containment currents applied to the inductors. The effect is to eliminate beat frequencies due to interaction between the plurality of inductors. The clock 22 may be comprised of a voltage controlled oscillator having individual isolated outputs 60, 60' connected to each of the plurality of pulse width modulating circuits 20', 20''. The master clock functions to signal the pulse width modulating circuits to synchronize turn-on of their respective associated inverters so as to synchronize the interaction between the inductors to eliminate any difference in the frequency between the containment currents delivered to the inductors.

Also, frequency set 62 is connected to the clock 22. It comprises a variable voltage source to set the frequency of the master clock 22 as is conventionally known in the art.

In operation, the multi-strand apparatus 10, in accordance with the embodiment of FIG. 2, receives and electromagnetically forms molten material into a plurality of ingots of desired shape. A plurality of inductors applies magnetic force fields to the molten material. Each of the inductors in operation is spaced from the material by a gap "d" extending from the surface of the molten material to the opposing surface of the inductor. An alternating containment current is applied to each of the plurality of inductors to generate the magnetic force field. The alternating current is delivered from a power source including a rectifier filter section 56, a chopper 54, and an inverter 52, 52'. The master clock 22 signals the pulse width modulating circuits 20', 20'' to signal their respective inverters to turn on and send current to the inductors. The frequency of the clock is initially set by the frequency set 62.

The pulse width modulating circuits also signal the inverters as to when to turn off. The time-on period of the inverter relates to the error signal A, A' from the control circuit which depends upon the hydrostatic pressure of the molten material within the inductor. The control circuit senses a change in the hydrostatic pressure of the molten material head. If the magnitude of the hydrostatic pressure change signal "0" increases or decreases with time, depending on whether the hydrostatic pressure is increasing or decreasing, then an appropriate control signal A, A' is sent to the pulse width modulating circuit. If the hydrostatic pressure is increasing, then the inverter must deliver current to the inductor for a longer period of time in order to support the larger hydrostatic head. On the other hand, if the head height is becoming smaller, the amount of current required will correspondingly decrease since a smaller magnetic field will be able to support the smaller head.

Figure 3:
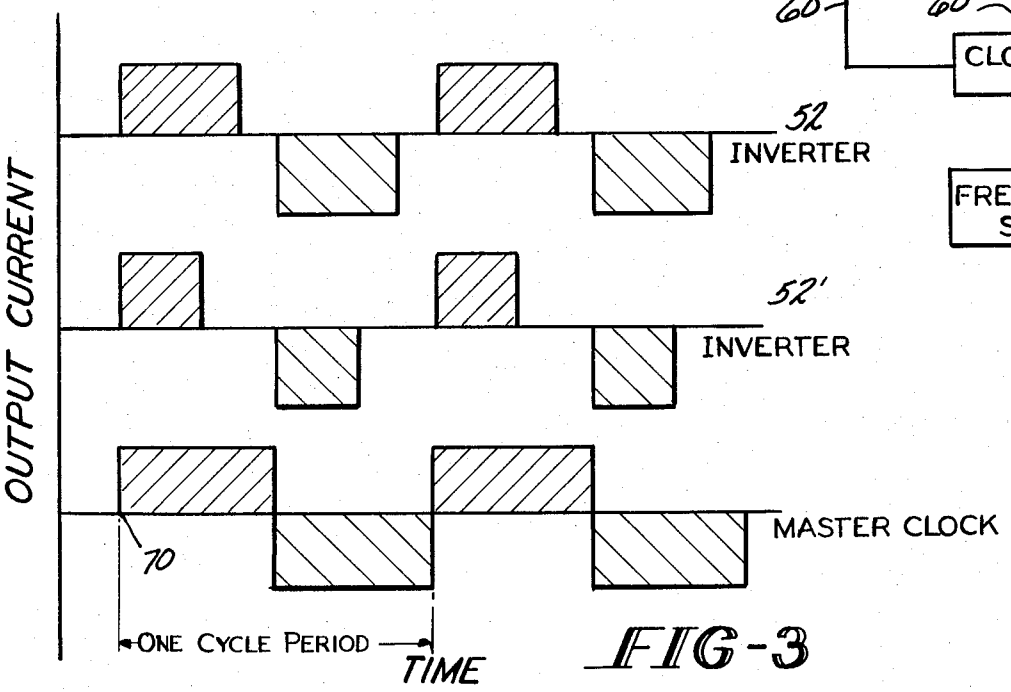
FIG. 3 is a timing diagram of the present invention.

Referring to FIG. 3, there is schematically illustrated the pulse width modulation of two inverters according to the demands of the master clock and their independent containment control circuits. It can be appreciated that when the master clock turns on at point 70, the inverters 52 and 52' are also turned on by the pulse width modulation circuit. The amount of time that the inverters are delivering current to their respective inductors is indicated by the width of the box extending along the time line and controlled by the pulse width modulating circuits in accordance with the output signal A, A' from the control circuits. Referring again to FIG. 3, it can be seen that the master clock signals the inverter turn-on twice in every one cycle. Thus, it would be possible for the clock to also turn off the inverter at the end of one-half of the cycle period. However, in practice the pulse width modulating circuit is set so that the longest duty cycle or pulse width of any inverter is 90% of the full half cycle. This may be set by control of the main chopper supply voltage so as to maintain and limit the longest duty cycle for pulse width to the 90% value. Thus, the longest on-time of any inverter divided by the half cycle time should be controlled at 0.9. This mode of operation minimizes system operating voltage and maximizes the sensitivity of the inverters pulse width modulating output and system stability and regulation while providing sufficient surge capacity to respond to any containment perturbation. The synchronized turn-on of current to the plurality of inductors results in the inductors having the same frequency as well as the same time relationship. Also, the implementation of this control method is possible with either analogue, digital or hybrid circuitry coupled to commercially available static choppers and inverters otherwise suitable for electromagnetic casting application as revealed in the literature.

It is apparent that there has been provided in accordance with this invention a multi-strand electromagnetic casting apparatus and method which fully satisfies the objects, means, and advantages set forth hereinabove. While the invention has been described in combination with the specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A multi-strand apparatus for casting molten material into ingots of desired shape, comprising:

a plurality of means for receiving and electromagnetically forming said molten material into ingots of said desired shape, each of said receiving and forming means including:

an inductor for applying a magnetic force field to the molten material, said inductor in operation being spaced from said molten material by a gap extending from the surface of the molten material to the opposing surface of the inductor;

means associated with each said inductor for sensing variations in its corresponding gap;

means for applying an alternating current to each said inductor to generate the magnetic force field associated with each inductor;

means for controlling the application of alternating current to each said inductor in response to the gap variation sensing means whereby variations in the gap of each said inductor are minimized;

said current applying means includes a plurality of inverters, each of said inverters connected with one of the inductors for applying current thereto; and clock means connected with said current applying means for simultaneously directing a turn-on signal to turn on all of said inverters at substantially the same time so as to synchronize the operating frequency of the inductors and substantially eliminate the development of beat frequencies.

2. The apparatus of claim 1 wherein the means for controlling the application of alternating current further includes a plurality of pulse width modulating means each being connected to one of said inverters and said clock means, each of said plurality of pulse width modulating means receiving said turn-on signal from said clock means for turning on its corresponding inverter and modulating the time period in which the inverter applies current to its associated inductor in response to sensed variations in the gap of its associated inductor.

3. The apparatus of claim 2 wherein each of the gap variation sensing means includes control circuit means for generating an error signal in response to variations in an electrical parameter of an associated inductor; each of the control circuit means being connected to an associated pulse width modulating means for applying the generated error signal to the associated pulse width modulating means whereby the length of on-time of each inverter is modulated in order to minimize variations in each of said gaps.

4. The apparatus of claim 3 wherein said clock means is a voltage controlled oscillator with a plurality of individual outputs each being connected to one of the plurality of pulse width modulating means.

5. The apparatus of claim 4 wherein said clock means further includes a frequency set circuit means for setting the frequency of oscillation of the clock means and the operating frequency of the inductors.

6. A process for casting molten material into ingots of desired shape, comprising the following steps:

receiving and electromagnetically forming molten material into a plurality of ingots of desired shape, said step of receiving and forming including the steps of:

providing a plurality of inductors for applying magnetic force fields to the molten material, each of said inductors in operation being spaced from said molten material by a gap extending from the surface of the molten material to the opposing surface of the inductor;

sensing variations in each of the gaps;

applying an alternating current to each of said plurality of inductors to generate the magnetic force field associated with each inductor;

providing a plurality of inverters connected with said plurality of inductors, each of said inverters being connected with one of said plurality of inductors for applying said alternating current thereto;

controlling the application of alternating current to each of said plurality of inductors in response to the sensed variations of their corresponding gaps whereby variations in the gaps are minimized;

providing a clock connected to each of said inverters;

simultaneously applying a turn-on signal with said clock to turn-on all of said inverters at substantially the same time; and applying a turn-off signal simultaneously to each of said inverters so in order to synchronize the operating frequency of the inductors and substantially eliminate the development of beat frequencies.

7. The process as in claim 6 including the steps of:

measuring variations in an electrical parameter of each of said inductors and generating error signals, each of said error signals corresponding to the gap variation in a corresponding inductor;

providing a plurality of pulse width modulating devices, each being connected between one of said inverters and said clock;

applying each of said error signals to a corresponding pulse width modulating device; and modulating the time period that each inverter delivers current to its corresponding inductor with the corresponding pulse width modulating device whereby variations in each of said gaps is minimized.

8. The process as in claim 6 further including the step of setting the frequency of oscillation of the clock.

* * * * *